United States Patent [19]

Bocquet

[11] Patent Number: 4,717,601

[45] Date of Patent: Jan. 5, 1988

[54] PROCESS AND DEVICE FOR WAXING SKIS BY SPRAYING

[75] Inventor: Jean-Pierre Bocquet, La Motte Servolex, France

[73] Assignee: Skid, La Motte Servolex, France

[21] Appl. No.: 835,046

[22] Filed: Feb. 28, 1986

[30] Foreign Application Priority Data

Feb. 28, 1985 [FR] France ..... 85 03471

[51] Int. Cl.[4] ..... B05D 1/02

[52] U.S. Cl. ..... 427/421; 118/302; 118/323; 118/72

[58] Field of Search ..... 427/421, 422; 118/302, 118/323, 72; 239/302, 284 R

[56] References Cited

U.S. PATENT DOCUMENTS

| | | | |
|---|---|---|---|
| 1,935,571 | 11/1933 | Lagerholm | 239/360 X |
| 2,016,407 | 10/1935 | Wentzel | 427/422 X |
| 2,588,125 | 3/1952 | Knowland et al. | 117/104 |
| 2,879,180 | 3/1959 | Page et al. | 117/102 |
| 3,045,639 | 7/1962 | Kurlander et al. | 118/302 |
| 3,050,416 | 8/1962 | Yahnke et al. | 427/422 X |
| 3,136,659 | 6/1964 | Walker et al. | 118/11 |
| 3,888,412 | 6/1975 | Lindo | 239/284.1 |
| 4,181,093 | 1/1980 | Tredwell | 118/323 |

FOREIGN PATENT DOCUMENTS

| | | |
|---|---|---|
| 1561949 | 4/1969 | France . |
| 2422419 | 11/1979 | France . |

*Primary Examiner*—Shrive P. Beck
*Attorney, Agent, or Firm*—Ratner & Prestia

[57] ABSTRACT

A process and device are provided for waxing skis by spraying. The skis are held vertically in a support. A spraying device, mounted on vertical guides, sprays on the surface to be waxed a mixture of wax and volatile solvent. The spraying device comprises a reservoir and a vane pump forcing the liquid mixture into a spraying nozzle.

11 Claims, 6 Drawing Figures

PROCESS AND DEVICE FOR WAXING SKIS BY SPRAYING

BACKGROUND OF THE INVENTION

1. Field of the Invention

The present invention relates to means for applying a layer of wax on the surface of skis.

2. Description of the Prior Art

Waxing operations are usually achieved in one of the following ways:

the wax may be applied by rubbing a block of solid wax on the surfaces of the ski; the application is uneven and since it is carried out manually it is tiresome;

a second solution gives better results: an impregnation wax, in the form of a paste in a tube or tin is applied by means of a rag. The application is necessarily manual and the results are mediocre, probably because of an insufficient penetration of the wax into the small cavities of the surface of the ski;

a very widely used method, described more particularly in the document FR-A-No. 1 561,949, consists in melting a block of solid wax at a temperature between 80° and 120° celsius; it is then applied by means of a rotary drum plunging partially into the wax and over which the surface to be waxed is slid; this method has several drawbacks for the wax heated to a relatively high temperature produces unpleasant, nauseous and possible harmful smoke; the amount of wax deposited on the surface is generally too great and the excess must be scraped off during a subsequent operation; furthermore, the application is uneven when the surface is not flat, concave or convex.

SUMMARY OF THE INVENTION

The object of the present invention is to avoid the drawbacks of known waxing methods and devices by providing a very even wax deposit over the surface of the ski: the wax film has a practically constant thickness which does not depend on possible irregularities of shape of the surface of the ski. It is therefore possible to deposit a very fine wax film. The amount of wax required may be minimized; the invention allows a considerable saving of wax, and does not require subsequent operations for removing any excess.

According to another object, the invention allows waxing to be obtained of better quality; measurements have shown that the invention increases the penetration of the wax into the small cavities in the surface of the ski, so that the waxing is durable and the slip is better.

The excellent quality of results obtained with the present invention allows waxing to be automated; in fact, the eveness of the results means that the user does not have to supervise the operation of the devices. And automation improves the evenness of the result.

According to another object of the invention, several surfaces disposed side by side over a relatively wide zone may be waxed simultaneously; a monoski may also be waxed in a single pass, that is to say a surface whose width is substantially greater than that of a normal ski.

One advantage of the invention is to allow waxing on a substantially vertical surface; thus the space required on the ground by the waxing device is considerably reduced.

To attain these objects as well as others, the applicants have sought to apply the wax by spraying; a irst solution involved liquifying the wax by heating it to a sufficient temperature; multiple tests have shown that the penetration of the wax is insufficient, particularly when the surface to be waxed is cold; furthermore, the wax tends to gel in the air and to be transformed into a powder before reaching the surface. It also appears that some solid waxes lose certain properties because of the heating.

The solution of the invention consists in spraying onto the surface to be waxed a low viscosity liquid solution of wax in a volatile solvent.

The applicants have tried to spray the liquid solution by pushing with a gas, for example compressed air. The method may be used but requires having a compressed air source available; now, the aim is to allow the waxing device to be used in ski repair workshops, which are practically never provided with compressed air production means. And when it is desired to push the liquid by means of a gas other than air, we come up against an incompatibility between the gas and certain waxes, disturbing more particularly the speed of evaporation and/or the waxing quality. It is preferable to spray the liquid solution by means of a pump forcing the liquid into at least one spraying nozzle. The spraying is more even, and the problems of compatibility are avoided.

In a subsequent phase, a current of hot air may be applied to the waxed surface, promoting evaporation of the solvent and gelling of the wax. Surprisingly, the applicants have discovered that the formation of a very fine wax film by spraying followed by heating gives considerably better results. Under certain test conditions, an increase of speed of 5% to 10% was measured for a skier using this waxing method. This result is not reached when a wax film is heated which was obtained by the traditional plunging roller and molten wax methods.

In an earlier phase, a current of hot air may also be applied to the surface to be waxed for drying it and/or bringing it to an adequate temperature.

The surfaces to be waxed are generally of an elongate shape. Preferably, spraying of the liquid mixture as well as application of a current of hot air are provided by sweeping the surface to be waxed in the longitudinal direction.

According to another feature of the invention, the waxing device comprises a liquid spraying device comprising a sealed reservoir for receiving a liquid mixture of wax and volatile solvent; the casing of the reservoir is pierced with a filling orifice closed by a plug and a small caliber nozzle for the intake of air and establishing the atmospheric pressure inside the reservoir; the pump connected to the reservoir forces the liquid into an outlet duct whose end comprises one or more spraying nozzles.

BRIEF DESCRIPTION OF THE DRAWINGS

Other objects, features and advantages of the present invention will be clear from the following description, of a particular embodiment with reference to accompanying Figures in which.

DESCRIPTION OF THE PREFERRED EMBODIMENTS

Figure 1:
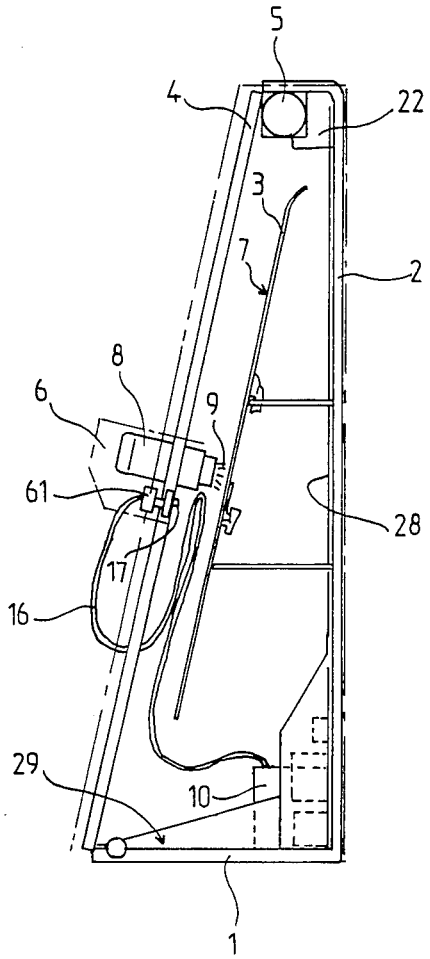
FIG. 1 shows a side view of a waxing device in accordance with the invention.

In the embodiment shown in the Figures, the device of the invention comprises a frame 1 having support means 2 for holding the ski 3 to be waxed. Preferably, support 2 holds the skis with their length in a substantially vertical position. It is however possible to operate the device of the invention with their length in a horizontal position, the surface to be treated being horizontal or, preferably, vertical. The frame further comprises guide means 4 such as vertical rails, associated with drive means 5. A carriage 6 carrying a liquid spraying device 61, slides along the rails or guide means 4 under the action of a drive means 5. The drive means 5 are formed for example by an electric motor unit with reduction gear driving an endless chain extending along the guide means 4 and a point of which is fixed to carriage 6. The spraying device 61 projects the wax onto the surface 7 to be waxed; for that, as shown in the Figures, the ski 3 is held by support 2 opposite the spraying device 61 mounted on the guide means 4.

The carriage supports a hot air production device 8, for example similar to known electric hair dryers, producing a hot air flow 9 directed towards the surface 7 of the ski. Preferably, device 8 is disposed above the liquid spraying device 61.

Figure 4:
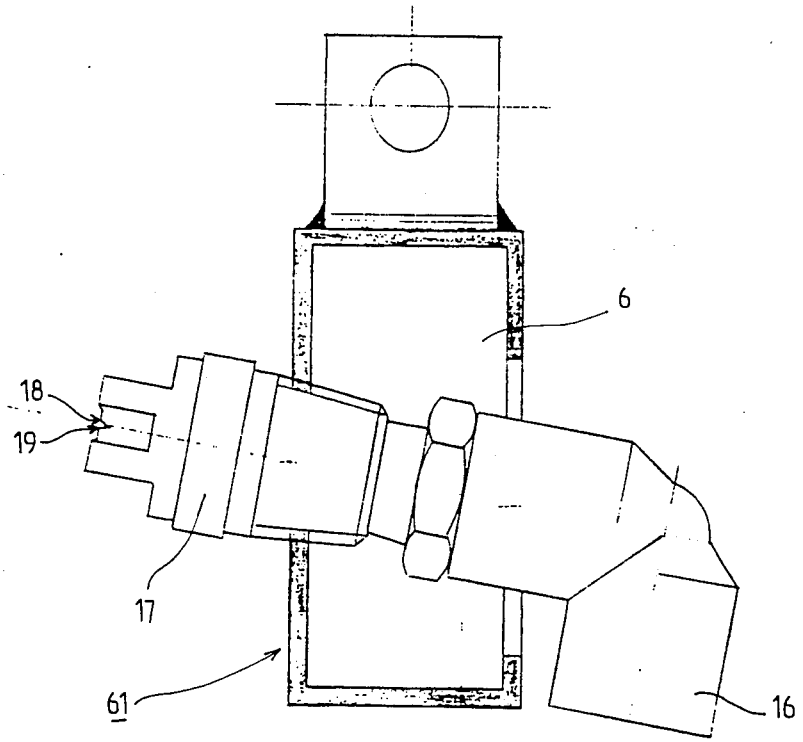
FIG. 4 shows a longitudinal sectional view of the spraying device.
Figure 6:
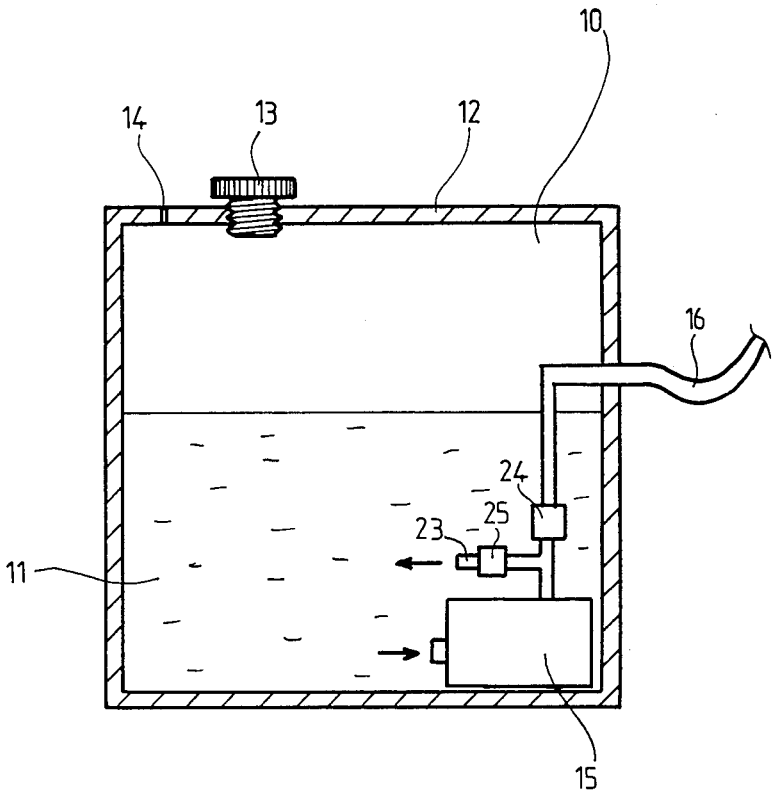
FIG. 6 shows a sectional view of the reservoir.

As can be seen in section in FIGS. 4 and 6, the device of the invention comprises a sealed reservoir 10 for receiving a liquid mixture 11 of wax and volatile solvent. The casing 12 of reservoir 10 is pierced with a filling orifice closed by a plug 13, through which are introduced the constituents of the liquid mixture 11. A small caliber nozzle 14 communicates the inside of reservoir 10 with the atmospheric pressure.

A pump 15 forces the liquid 11 from the reservoir into an outlet duct 16 whose end is connected to a spraying nozzle 17 of the spraying device 61.

Pump 15 may be a vane pump, or a centrifugal turbine pump. A pump external to the reservoir may also be used, for example an electromagnetic piston or membrane pump, for generating a higher pressure associated with a low delivery rate.

The pump is preceded by a filter whose mesh has a diameter preferably between 10 and 50 microns.

Figure 5:
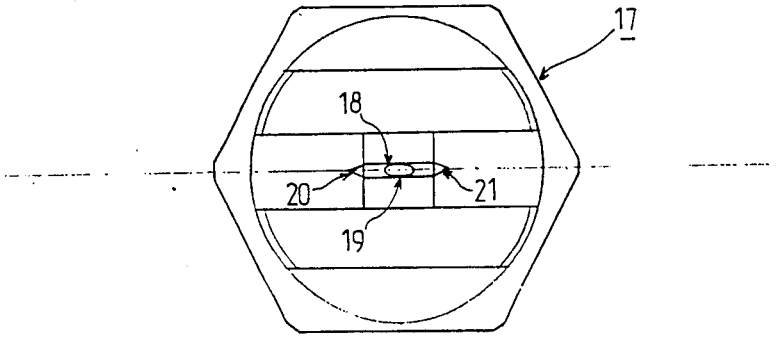
FIG. 5 shows a front view of the spraying nozzle.

As shown in the front view of FIG. 5, the spraying nozzle 17 comprises upper 18 and lower 19 very closely positioned and substantially parallel duct sides, limiting the vertical aperture of the sprayed jet; the nozzle comprises lateral sides 20 and 21 which are divergent and spaced further apart. Thus, the spreading jet is in the form of a flattened pyramid of small height and larger width for spraying the whole of the width of the surface to be waxed in a single pass. In the embodiment shown in FIG. 1, reservoir 10 is fixed, for example set on the floor, in a low position. Pump 15 is disposed immediately at the outlet of the reservoir, for example disposed in the bottom of the reservoir; thus a vane or turbine force pump can be used. The end of the outlet duct 16 and nozzle 17 are slanted slightly upwards, as shown in FIGS. 1 and 4, so as to direct the jet of liquid in an average slightly rising direction, forming an angle between 5° and 30° with horizontal. The relative positions of nozzle 17 and reservoir 10 are such that, during at least one operation phase, the reservoir is lower than the nozzle. Thus, during the same operating phase, when pump 15 is stopped, the liquid flows back from the outlet duct 16 into reservoir 10, and the nozzle is emptied and drained both by gravity flow of the liquid and by suction in duct 16. The applicants have discovered that these devices prevent the orifice of the spraying nozzle from being clogged during interruptions in operation of the device, by gelling of the wax in the nozzle.

The outlet duct 16 is flexible pipe, for example supported in the middle by a collar firmly secured to frame 1. The considerable height between reservoir 10 and nozzle 17, in this embodiment, promotes draining of the nozzle between the wax spraying phases. Furthermore, reservoir 10 contains a variable liquid level 11, and its weight is not constant; the fact of dissociating the reservoir and the spraying device 61 allows a practically constant balance of carriage 6 to be obtained, which balance may be ensured by a counterweight not shown in the Figures.

In a second embodiment, an electromagnetic piston type pump 15 is used external to the reservoir, and the reservoir and the pump are disposed on the moving carriage supporting the spraying means. Thus the length of the ducts is reduced, so that the spraying nozzles are pressurized instantaneously. The duct remains full, but the small diameter of the spraying hole prevents the wax from gelling too deeply in the nozzle; the high pressure generated by this type of pump, a pressure of the order of 5 bars, clears the nozzle at the beginning of operation.

The device functions as follows: in a first sweep from top to bottom, the hot air production device 8 dries the surface 7 to be waxed and heats it to an adequate temperature promoting penetration of the wax. Such sweeping with hot air is only required if the surface 7 is cold and/or damp, and may be omitted if the surface 7 is dry and at ambient temperature. During this same top to bottom sweep, the liquid spraying device 61 projects the sprayed liquid onto the surface 7 in a thickness determined by the delivery rate of the pump and the vertical moving speed of the spray device. At the end of the sweep, spraying is stopped. In a second sweep, from bottom to top, the hot air production device 8 is caused to travel at a slower speed, raises the temperature of the mixture applied on surface 7 and promotes rapid evaporation of the volatile solvent.

Figure 2:
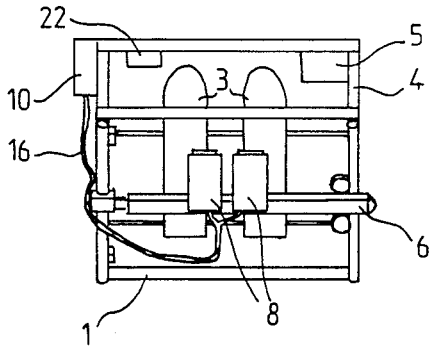
FIG. 2 shows a top view of the device of FIG. 1.
Figure 3:
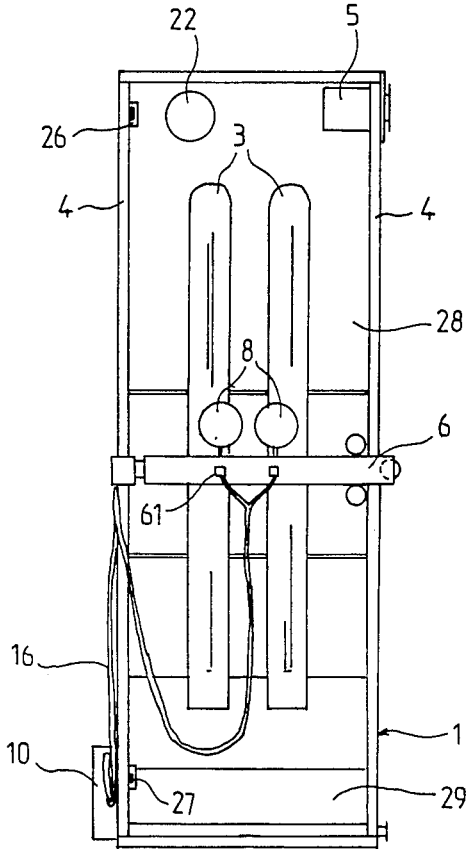
FIG. 3 shows a front view of the device of FIG. 1.

As shown in FIGS. 2 and 3, it is possible, with the device of the present invention, to simultaneously wax several surfaces, for example several skis placed side by side. It is also possible to wax a wide surface, for example the surface of a monoski. If required two nozzles 17 may be provided disposed side by side and fed through the same duct 16.

The wax and solvent mixture must be chosen so that the solvent evaporates at the temperature of use; its evaporation is prevented in the reservoir because the case is air tight, nozzle 14 alone allowing no substantial escape to the ambient atmosphere.

Conclusive tests were carried out with a solvent comprising in volume about 75% of petrol E and 25% of methylene chloride Petrol E is a known solvent which contains about 70 to 75% of C7 and C8 paraffin hydrocarbons, 20 to 25% of C7 and C8 cyclane hydrocarbons and less than 10% of benzene hydrocarbons of the toluene, xylene or benzene trace type. Other chlorinated solvents may prove appropriate when using certain particular types of wax.

The embodiment shown in the Figures allows the waxing to be automated. According to the present invention, it is however possible to use a simplified device, for example by omitting the support means 2 and guide 4 and drive 5 means. Then a portable assembly is defined comprising the liquid spraying device 6 and the reservoir 10, the assembly being actuated manually by the user.

In the most perfected embodiment shown in the Figures, the device further comprises a gas collector 22 which, associated with a discharge duct, collects the evaporated solvent for recycling it or discharging it outside the premises. The discharge may be preferably improved by fan means for drawing the gases into the discharge duct. Thus, the hot air production device 8 improves both the waxing speed and discharge of the evaporation products.

In the embodiment intended to be used outside, it is preferable to further provide means for heating the liquid mixture contained in the reservoir, for maintaining the mixture at a temperature greater than about 15° C. Thus premature gelling is avoided. Heating may be provided for example by an electric resistance plunging into the liquid and fed with electric power.

In a preferred embodiment, which is very effective, the device according to the invention further comprises means for heating the nozzle. The heating of the nozzle, at a temperature higher than the melting temperature of the wax, for example higher than 40° C., avoids premature gelling of the wax in the nozzle. The heating may be provided for example by electric resistances near the nozzle, or by directing the hot air production device so that the nozzle is plunged into the hot air flow.

Sometimes, the volatile solvents have a density different from that of the wax; it then proves necessary to provide means for homogenizing the mixture in the reservoir, particularly when it is desired to use the device intermittently over several hours. For example, in a particular embodiment, reservoir 10 further comprises a recycling duct 23 connected at the pump outlet and reinjecting liquid into the reservoir for stirring it.

The pump then fulfills the two functions of stirring and spraying. The two functions may be simultaneous: during the spraying phase, a portion of liquid is fed into duct 16 whereas another portion is recycled into duct 23; at the end of spraying, the pump is stopped until the next spraying operation.

If it is desired to use a pump 15 of lower power, or if homogeneization must be ensured over a long period between two spraying operations, it is then necessary to separate the stirring and spraying functions. The separation may be provided by means of electromagnetic valves 24 and 25, or an equivalent three ways valve, connecting the outlet of pump 15 either to duct 16 for spraying or to ducts 23 for stirring. However, at the end of spraying, nozzle 17 msut be drained; the simple fact of closing valve 24 prevents such draining; then the following operating method may be used: at the end of spraying, pump 15 is stopped and, after a predetermined time from 0.5 seconds to 2 minutes, valve 24 is closed then valve 25 is opened and the pump is set in operation for stirring.

Preferably, the elements of the device are controlled by electronic control means not shown in the Figures, for controlling the operating cycles. The control means receive the information from two end of travel switches 26 and 27, mounted on frame 1 and detecting the presence of carriage 6 in a high position and a low position. Switches 26 and 27 may have an adjustable position which the user will choose depending on the length of the skis to be waxed for defining the waxing range. Carriage 6 is initially at rest in the high position, spraying being stopped and pump 15 possibly providing stirring. The user produces a beginning of cycle signal, by means of a switch connected to the control means. The control means then cause pump 15 to operate then, after predetermined time delay, causing duct 16 to be filled, the drive means 5 to be set in operation and the downward movement of carriage 6 for spraying and, possibly, device 8 to be actuated for the first hot air sweep. On reception of the signal produced by the end of travel switch 27, spraying is stopped, carriage 6 travels up as far as switch 26 for the next phase while carrying out a hot air sweep.

Spraying generally extends beyond the surface 7 of the skis. A frame bottom 28 may be provided covered with disposable sheets made from an absorbant paper type of material and a recovery tank 29 may be placed at the lower part.

The present invention is not limited to the embodiments which have been more explicitly described, but it includes the different variants and generalization thereof contained within the scope of the following claims.

What is claimed is:

1. Apparatus for waxing by spraying the running surface of a ski, said apparatus comprising:

a. a closed reservoir;

b. a supply of low viscosity liquid mixture within said reservoir;

c. said liquid mixture comprising a solution of wax and volatile solvent;

d. said reservoir having a fill orifice closed by a plug and a small vent for the intake of air to establish atmospheric pressure inside said reservoir;

e. an output duct connected to said reservoir;

f. at least one spray nozzle at the output end of said duct;

g. said nozzle positioned to be directed toward the surface to be waxed;

h. a pump for forcing said liquid mixture from said reservoir into said duct and into and through said spray nozzle;

i. a frame having support means for holding a ski to be waxed;

j. guide means for supporting said spray nozzle and holding it in a position directed toward the running surface of said ski; and k. drive means for moving said nozzle translationally in the lengthwise direction of said ski for sweeping along the surface to be waxed.

2. Apparatus according to claim 1 further characterized by the provision of heating means for heating the nozzle to a temperature higher than the melting temperature of the wax.

3. Apparatus according to claim 1 wherein:

a. said frames support said ski in a generally vertical position;

b. said spray nozzle is directed at an upward angle such that said liquid mixture is projected in a slightly rising direction;

c. said nozzle and said reservoir are so positioned that during at least one operating phase, said reservoir is at a lower elevation than said nozzle so that during this operating phase when the pump is stopped, the liquid mixture will flow back down from the output duct and from the nozzle into the reservoir and the nozzle will become drained by gravity and by suction thereby avoiding having the nozzle orifice from becoming clogged when the pump is stopped.

4. Apparatus according to claim 1 characterized in the provision of a hot air production device for projecting hot air against the surface being waxed to promote penetration of the wax into the running surface of the ski and to promote evaporation of the solvent.

5. Apparatus according to claim 4 further characterized in the provision of control means for controlling said pump, said guide means and said hot air production device.

6. Apparatus according to claim 5 wherein said control means are adapted to cause said pump and said guide means to operate during a waxing phase to spray said liquid solution of wax and solvent on the running surface of the ski being waxed.

7. Apparatus according to claim 6 wherein in an initial phase, said control means causes the guide means and the hot air production device to operate to project hot air onto the running surface of the ski prior to waxing.

8. Apparatus according to claim 1 wherein said liquid mixture is a solution of wax in a solvent comprising about 75% in volume of petrole E and about 25% of methylene chloride.

9. A method of waxing the gliding surface of a ski comprising the steps of:

a. providing a low viscosity liquid mixture comprising a solution of wax in a volatile solvent;

b. spraying the liquid wax onto the running surface of the ski by pumping said liquid mixture through the orifice of a spray nozzle;

c. applying heat to the ski surface before the liquid mixture is sprayed onto the ski surface to facilitate penetration of the wax into the pores of the surface of the ski and applying heat to the ski surface after the liquid mixture is sprayed onto the ski surface to promote evaporation of the solvent from the surface of the ski.

10. The method of claim 9 wherein the spray is automatically moved translationally in the longitudinal direction of the ski.

11. Apparatus for waxing by spraying the running surface of a ski, said apparatus comprising:

a. a closed reservoir;

b. a supply of low viscosity liquid mixture within said reservoir;

c. said liquid mixture comprising a solution of wax and volatile solvent;

d. said reservoir having a fill orifice closed by a plug and a small vent for the intake of air to establish atmospheric pressure inside said reservoir;

e. an output duct connected to said reservoir;

f. at least one spray nozzle at the output end of said duct;

g. said nozzle positioned to be directed toward the surface to be waxed;

h. a pump for forcing said liquid mixture from said reservoir into said duct and into and through said spray nozzle;

i. a frame having support means for holding a ski to be waxed;

j. guide means for supporting said spray nozzle and holding it in a position directed toward the running surface of said ski;

k. drive means for moving said nozzle translationally in the lengthwise direction of said ski for sweeping along the surface to be waxed;

l. a hot air production device for projecting hot air against the surface being waxed to promote penetration of the wax into the running surface of the ski and to promote evaporation of the solvent;

m. control means for controlling said pump, said guide means and said hot air production device;

wherein said control means are adapted to cause said pump and said guide means to operate during a waxing phase to spray said liquid solution of wax and solvent on the running surface of the ski being waxed; and wherein in a subsequent phase, said control means stops the pump and the spraying of said liquid mixture of wax and causes the guide means and the hot air production device to operate to project hot air onto the wax surface.

* * * * *